United States Patent [19]

Fach

[11] 4,084,712

[45] Apr. 18, 1978

[54] CHARGING TRUCK FOR FEEDING COAL INTO HORIZONTAL-CHAMBER COKE-OVENS

[75] Inventor: Horst Fach, Essen, Germany

[73] Assignee: Didier Engineering GmbH, Essen, Germany

[21] Appl. No.: 700,304

[22] Filed: Jun. 28, 1976

Related U.S. Application Data

[62] Division of Ser. No. 593,045, Jul. 3, 1975, Pat. No. 4,018,655.

[51] Int. Cl.[2] ..... C10B 31/04

[52] U.S. Cl. ..... 214/35 R

[58] Field of Search ..... 214/18 PH, 35 R; 201/40; 202/262, 263

[56] References Cited

U.S. PATENT DOCUMENTS

| | | | |
|---|---|---|---|
| 1,376,313 | 4/1921 | Becker | 214/18 PH X |
| 1,376,314 | 4/1921 | Becker | 202/263 |
| 3,542,218 | 11/1970 | Herbst | 214/18 PH |

*Primary Examiner*—Robert G. Sheridan

*Attorney, Agent, or Firm*—Wenderoth, Lind & Ponack

[57] ABSTRACT

Coal is first fed into the oven chamber through a plurality of first filling units of a charging truck into first filling openings until the bases of the resultant cone-shaped charges are approximately in contact. Thereafter, coal is fed through a plurality of second filling units of the charging truck into a plurality of second filling openings positioned between adjacent first filling openings. The above operations are repeated until the oven chamber is filled. The coarser coal is thus distributed in a plurality of diagonal layers in the oven chamber. Filling gas is removed from the oven chamber during feeding through filling openings and filling units of the charging which are not being employed for feeding.

4 Claims, 9 Drawing Figures

FIG. 8
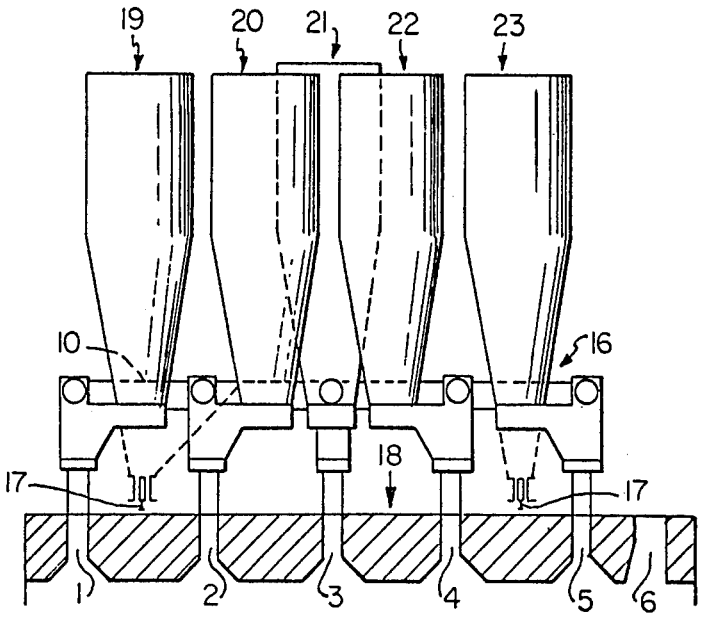
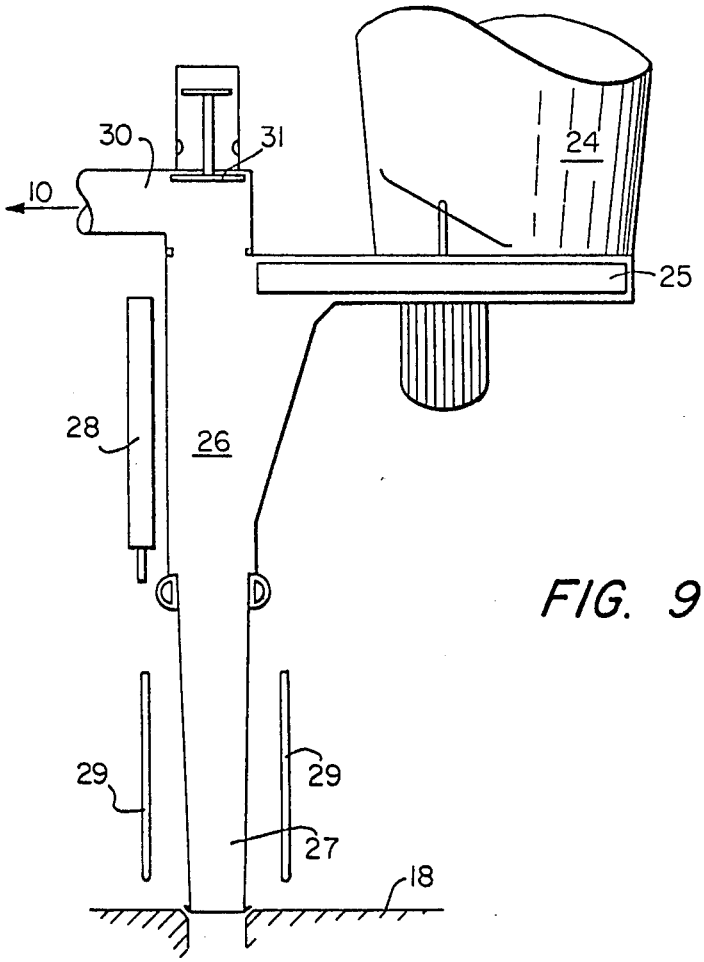
FIG. 9

CHARGING TRUCK FOR FEEDING COAL INTO HORIZONTAL-CHAMBER COKE-OVENS

This is a division, of application Ser. No. 593,045, filed July 3, 1975, now U.S. Pat. No. 4,018,655.

BACKGROUND OF THE INVENTION

The present invention relates to a charging truck for feeding coal into horizontal-chamber coke ovens, wherein a plurality of first filling openings and a plurality of second filling openings, each positioned between adjacent first filling openings, are arranged side by side in each coke oven chamber.

Coke ovens comprising a plurality of oven chambers, each of which possesses juxtaposed filling openings, are generally filled by introducing coal simultaneously through every filling opening. After an oven chamber is filled, the truck is driven to the next oven chamber. The filling gases produced during the introduction of the coal into the hot oven chamber are either removed from the oven chamber through a riser or led off through pipes that are additionally introduced into the filling openings and connected to the charging truck.

It has been determined that the coke formed after the carbonization of the coal is not uniformly carbonized. This can be explained by the fact that the introduced coal is irregular in grain size, and that during the charging operation the coarser coal is always gathered on the surface of the resultant cone-shaped charge, so that as a final result the coarser coal is situated in vertical layers between two filling openings.

A further disadvantage of the known system is that low-emission removal of the filling gases is rendered difficult when the coal is introduced simultaneously through every filling opening.

SUMMARY OF THE INVENTION

In order to eliminate the above disadvantages, the object of the present invention is to provide a charging truck with which the oven may be charged such that uniformly-carbonized coke may be produced, and such that filling gases may be effectively removed from the oven.

The process of operating the charging truck of the invention is characterized in that in a first portion of the process a partial fill is introduced into the oven chamber through a plurality of first filling openings until the bases of the cone-shaped charges thus formed approximately contact each other. In a second portion of the process a further partial fill is introduced into the oven chamber through second filling openings positioned between the first filling openings. Subsequently, filling through the first and second filling openings is alternately repeated until the oven chamber is filled. This charging process produces a distribution of the coarser coal in a plurality of diagonal layers in the oven chamber. Accordingly, such layers are not aligned in parallel with the heating flues that are arranged vertically in the walls of the oven chambers, so that all together a uniform carbonization of the coal is obtained. Owing to the intermittent feeding of the coal, the filling openings that are not charged at a particular time may be used for the removal of the filling gas, so that during each portion of the process the filling gas is taken from the oven chamber through the filling openings which are not being used for filling.

Further, the first portion of the process takes place in two steps. In the first step, a charge is filled through a filling opening positioned adjacent to a riser leading from the oven chamber. In the second step, charges are filled through the remaining first filling openings. This has the advantage that the filling opening charged in the first step may be used for conducting filling gas both in the second step of the first portion of the process and also in the second portion of the process. The corresponding development of the process is characterized in that the filling gas is led through the first or second filling openings into a manifold or collecting pipe provided on a charging truck, and in that the filling gas is led from the manifold through the filling opening positioned adjacent to the riser back into the oven chamber and is then removed through the riser.

In order to obtain a particularly uniform distribution of coal in the oven chamber, the second portion of the process is ended with advantage a short time before the coal would run over the cone-shaped charges introduced during the first portion of the process.

Furthermore, in the first portion of the process there is preferably introduced through each of the first filling openings a partial fill of approximately 30% of the total charge to be introduced through each first filling opening. In the second portion of the process there is preferably introduced a partial fill of approximately 80% of the total charge to be introduced through each of the second filling openings.

The charging truck comprises a plurality of feeder hoppers and charging connections leading from the hoppers to the respective filling openings. According to the invention, the charging truck includes a branch pipe leading from each charging connection to a common manifold. The filling gas can thus be led into the manifold from each of the filling openings associated with the charging connections, and the filling gas can be removed from the manifold. In particular, the filling gas removed from the filling openings can be led from the manifold back into the chamber, through the charging connection associated with the filling opening which is positioned adjacent to the riser, and then removed into the riser.

A shutoff valve is preferably arranged in each branch pipe, and the shutoff valves are so controlled as to open when the oven chamber is not being filled through the charging connections associated therewith.

BRIEF DESCRIPTION OF THE DRAWINGS

Further advantageous features of the invention will be apparent from the following description of one example of the apparatus of the invention, taken with the accompanying drawings, wherein:

FIG. 8 is a schematic frontal elevation of a charging truck according to the invention; and FIG. 9 is a schematic side view of the charging truck shown in section.

DETAILED DESCRIPTION OF THE INVENTION

Figure 1:
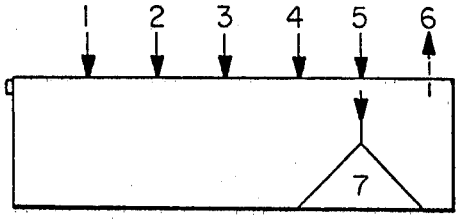
FIGS. 1 to 7 are schematic illustrations of the sequence of the steps of the process for employing the apparatus of the invention.

FIGS. 1 to 7 show an oven chamber having first filling openings 1, 3 and 5 and second filling openings 2 and 4. Further, a riser 6 is connected to the oven chamber. In the first step of the first portion of the process, which is represented in FIG. 1, coal is filled through filling opening 5 positioned adjacent riser 6. This filling operation produces a cone-shaped charge 7. This first step is ended when the outer edge of the cone-shaped charge 7 is situated approximately perpendicularly or vertically below filling opening 4. The coarser coal is gathered in the areas of the outer surface or jacket of cone-shaped charge 7, especially in the lower portion thereof. The filling gases produced during the charging operation are removed directly through riser 6.

Figure 2:
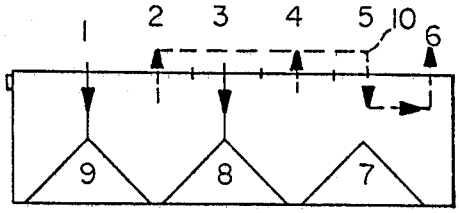

In the next step of the first portion of the process, which is represented in FIG. 2, the oven chamber is charged simultaneously through filling openings 1 and 3. This produces cone-shaped charges 8 and 9. This filling operation is stopped when the bases of the cone-shaped charges almost contact each other. Here also the coarser coal is again deposited on the outer surfaces of the cone-shaped charges. Approximately 30% of the coal to be introduced through each filling opening 1, 3 and 5 is introduced through each of such filling openings during the above operations. The filling gases formed in the second step are passed through filling opening 2 and filling opening 4 into a manifold 10, and then pass through filling opening 5, which is adjacent to riser 6, back into the oven chamber. From there, the filling gases are directly removed through riser 6.

Figure 3:
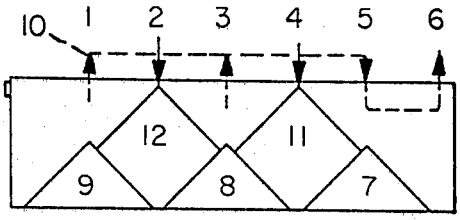

The above described first portion of the process is followed by a second portion of the process (see FIG. 3).

Here, the coal is charged simultaneously through filling openings 2 and 4. This produces cone-shaped charges 11 and 12, that are respectively positioned between cone-shaped charges 7 and 8 and 8 and 9. Here also the coarser coal is gathered on the outer surfaces of the charges. The filling performed through openings 2 and 4 is stopped before the coal flows over the tops of cone-shaped charges 7, 8 and 9, so that additional coarse-grained coal from charges 11 and 12 is not gathered on the outer surface of cone-shaped charges 7, 8 and 9. There is introduced in this step of the process approximately 80% of the total amount of coal to be introduced through openings 2 and 4. The filling gases are led through openings 1 and 3 into manifold 10. The gases return into the oven chamber through filling opening 5 and then pass from the chamber into riser 6. The trajectory of the filling gases is indicated in FIGS. 1 to 7 in each case by means of dashed lines.

Keeping in mind the extension of the oven chamber in the direction perpendicular to the plane of the drawings in FIGS. 1 to 7, the filling operation produces true cones each having a circular cross section or flattened cones at the walls of the oven chamber.

Figure 4:
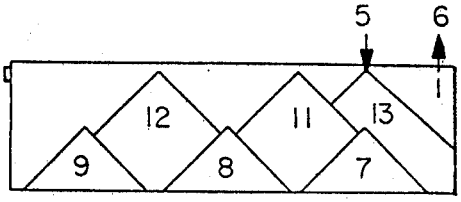

The step of the process represented in FIG. 4 is a repetition of the step described with reference to FIG. 1. The charge introduced in this operation is designated by numeral 13.

Figure 5:
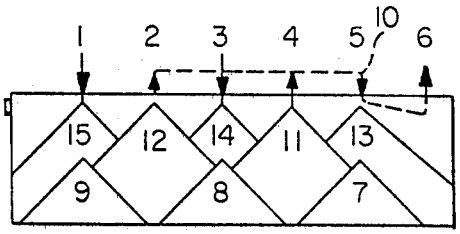

The step of the process represented in FIG. 5 is likewise a repetition of the step described with reference to FIG. 2. The charges introduced in this operation are designated by numerals 14 and 15. The total charge to be introduced into the oven chamber through filling openings 5, 3 and 1 is brought into the oven chamber with charges 13, 14 and 15.

Figure 6:
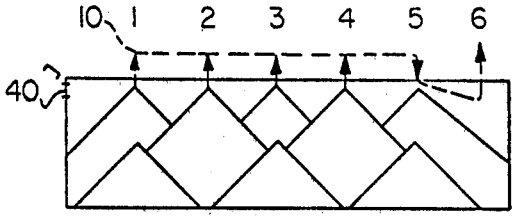
Figure 7:
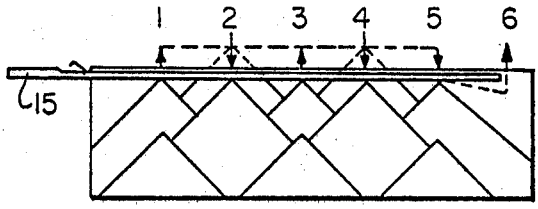

FIG. 6 shows an intermediate step of the process, wherein the filling gas is removed through openings 1 – 4. A levelling or grading opening 40 in the side of the chamber is opened. Through opening 40 can be introduced a levelling tool 15 which levels the tips of the fills (see FIG. 7). At the same time, and as a repetition of the step of FIG. 3, the residual charge to be introduced through openings 2 and 4 is poured into the oven chamber through such openings.

From the drawings it can be seen that the surfaces of the charges, whereat the coarser coal is necessarily gathered, extend diagonally in the oven chamber. This guarantees a uniform carbonization of the coal.

Further, from the drawings it can be seen that the filling openings which are not used for feeding coal are available for conducting the filling gases.

During each of the steps described the charging truck communicates with selected of the filling openings 1 to 5 through corresponding charging connections. The total filling time amounts to about two minutes.

FIG. 8 illustrates a charging truck 16 which can be transported on rails 17 that are placed on a cover 18 of the oven. Charging truck 16 has five filling units 19 – 23, that are each associated with one of the filling openings 1 – 5.

FIG. 9 shows one of the filling units more in detail. Each filling unit includes a feeder hopper 24 which is open on its lower side. A conveying device is arranged at such position and may be, e.g. a dish wheel, a vibrating trough, or a screw conveyor 25, which conveys the coal stored in hopper 24 as required to a charging connection 26. Connection 26 has at the lower end thereof a discharge pipe 27 that can be telescoped by means of hydraulic lifting cylinders 28 and piston rods 29. The discharge pipe 27 can be also pivoted within certain limits, so that it can be adapted to the specific position of the filling opening.

A branch pipe 30 opens into charging connection 26 above conveying device 25. The branch pipe 30 can be closed with respect to charging connection 26 by means of a shutoff valve 31. At the end thereof situated opposite charging connection 26, the branch pipes 30 of each of filling unit 19 – 23 end in a common manifold 10.

The operation of shutoff valves 31, conveying devices 25 and lifting cylinders 28 may be controlled through known hydraulic or electric means.

The operation of the charging truck is as follows.

When coal is to be supplied into the oven chamber from a feeder hopper 24 through the filling opening associated therewith, conveying device 25 is started, and the coal conveyed thereby drops through charging connection 26 and discharge pipe 27 into the oven chamber. Shutoff valve 31 is closed during this operation. When the desired amount of coal is supplied into the oven chamber, which amount may be measured, e.g. by means of a level detector, or predetermined by setting the operation time of conveying device 25, then conveying device 25 is switched off and shutoff valve 31 is opened. The level may be checked visually through sight holes.

For example, if at a time when coal has been conveyed into the oven chamber from the feeder hoppers of filling devices 19 and 21, and the conveying devices associated with such filling units are switched off and the shutoff valves associated therewith are opened, the filling gas formed during the subsequent filling of the oven chamber from filling units 20 and 22, may flow through charging connections 26 of filling units 19 and 21 and corresponding branch pipes 30 into manifold 10. From there the filling gas is led past the branch pipes 30 of filling units 20 and 22, that are closed by the respective shutoff valves 31 thereof, to the branch pipe 30 of filling unit 23 and passes through corresponding charging connection 26 thereof back into the chamber and from there into riser 6.

It will be apparent that many modifications may be made to that described above without departing from the scope of the present invention.

What is claimed is:

1. A charging truck for feeding coal into horizontal-chamber coke-ovens of the type including a plurality of filling openings arranged side by side in each oven chamber and a riser positioned adjacent one of said filling openings, said charging truck comprising:

a plurality of filling units, one for each of said filling openings, each said filling unit comprising:

a feeder hopper having a lower end;

a charging connection located at a position laterally offset from said feeder hopper, said charging connection having a lower end adapted to extend to a respective filling opening and an upper end, said charging connection being permanently open and free of obstruction from said upper end to said lower end thereof;

selectively operable conveying means positioned for selectively conveying coal from said lower end of said feeder hopper to said upper end of said charging connection such that the thus conveyed coal falls by gravity through said charging connection and into the respective filling opening, the passage of coal from said lower end of said feeder hopper to said upper end of said charging connection being blocked when said conveying means is not operated;

a branch pipe connected to and communicating with the interior of said charging connection at said upper end thereof at a position above said conveying means; and selectively operable shutoff valve means positioned in said branch pipe for selectively opening and closing communication between said interior of said charging connection and said branch pipe; and a manifold directly connected to said branch pipes of each of said filling units, said manifold being entirely closed and free of connection or communication with any elements other than said branch pipes.

2. A charging truck as claimed in claim 1, wherein said plurality of filling units comprises an odd number of filling units that are associated with a corresponding number of filling openings.

3. A charging truck as claimed in claim 2, wherein said charging truck includes five filling units charging connections that are associated with five corresponding filling openings.

4. A charging truck as claimed in claim 1, wherein each said charging connection includes an adjustable discharge pipe.

* * * * *